US010878725B2

(12) United States Patent
Ogren

(10) Patent No.: US 10,878,725 B2
(45) Date of Patent: Dec. 29, 2020

(54) PRINTABLE BLANK SHEET FOR FORMING OBJECTS

(71) Applicant: Blank Acquisition, LLC, Brooklyn Park, MN (US)

(72) Inventor: Andrew R. Ogren, Woodbury, MN (US)

(73) Assignee: Blank Acquisition, LLC, Brooklyn Park, MN (US)

( * ) Notice: Subject to any disclaimer, the term of this patent is extended or adjusted under 35 U.S.C. 154(b) by 0 days.

(21) Appl. No.: 16/733,992

(22) Filed: Jan. 3, 2020

(65) Prior Publication Data

US 2020/0219419 A1 Jul. 9, 2020

Related U.S. Application Data

(60) Provisional application No. 62/787,956, filed on Jan. 3, 2019.

(51) Int. Cl.

| | |
|---|---|
| ***G09F 3/10*** | (2006.01) |
| ***G09F 3/02*** | (2006.01) |
| ***B42D 15/02*** | (2006.01) |
| ***B41J 13/00*** | (2006.01) |

(52) U.S. Cl.

CPC ..... *G09F 3/10* (2013.01); *B41J 13/00* (2013.01); *B42D 15/02* (2013.01); *G09F 2003/0201* (2013.01); *G09F 2003/0241* (2013.01); *G09F 2003/0257* (2013.01)

(58) Field of Classification Search

CPC ..... G09F 3/10; G09F 2003/0201; G09F 2003/0241; G09F 2003/0257

See application file for complete search history.

(56) References Cited

U.S. PATENT DOCUMENTS

| | | | | |
|---|---|---|---|---|
| 4,910,058 | A * | 3/1990 | Jameson | G09F 3/0288 283/101 |
| 5,318,326 | A | 7/1994 | Garrison | |
| 5,509,693 | A | 4/1996 | Kohls | |
| 5,529,345 | A | 6/1996 | Kohls | |
| 5,534,320 | A | 7/1996 | Raby | |
| 5,613,349 | A | 3/1997 | Brown | |
| 5,662,976 | A | 9/1997 | Popat et al. | |
| 5,840,143 | A | 11/1998 | Swanson | |
| 5,871,828 | A | 2/1999 | Volkert | |
| 7,467,487 | B2 | 12/2008 | Sato et al. | |
| 7,534,476 | B2 | 5/2009 | Banks et al. | |
| 2005/0147781 | A1 * | 7/2005 | Dronzek, Jr. | B42D 5/00 428/40.1 |

* cited by examiner

*Primary Examiner* — Patricia L. Nordmeyer

(74) *Attorney, Agent, or Firm* — Kinney & Lange, P.A.

(57) ABSTRACT

A printable blank sheet includes a top substrate, a center layer adhered to the top substrate with a permanent adhesive, and a release liner adhered to the center layer with a removable adhesive. Perimeter cut lines extend through the top substrate and the center layer of the printable blank sheet and define a perimeter of an object blank in the printable blank sheet. A center cut line extends through the top substrate and into but not through the center layer on the object blank that defines a first object half and a second object half of the object blank.

20 Claims, 8 Drawing Sheets

PRINTABLE BLANK SHEET FOR FORMING OBJECTS

CROSS-REFERENCE TO RELATED APPLICATION(S)

This application claims priority to U.S. Provisional Application No. 62/787,956, filed on Jan. 3, 2019, and entitled "Business Cards," the disclosure of which is incorporated by reference in its entirety.

BACKGROUND

The present invention relates to printable blank sheets, and in particular, to printable blank sheets that are capable of forming objects, such as business cards.

Custom print materials have become a common way for businesses to market themselves. Custom print materials that are typically used in advertising include products like business cards, postcards, flyers, calendars, and door hangers. Typically, custom print materials are sent to print shops that specialize in preparing custom print materials, as the materials have had to be printed and assembled by specialized machines. As a result, having custom print materials made can be costly and time-consuming. Some templates are available that allow a user to make their own custom print materials without having to send their order to a print shop. An example of this includes printable blank sheets for creating personal objects, such as business cards.

Printable blank sheets for creating personal objects, such as business cards, usually include multiple objects on a sheet with perforations surrounding the outline of the objects and running through the entire sheet. The sheet can be passed through a printer and then the sheet can be folded and separated along the perforations to create individual objects. One drawback that exists with the current sheets are that the edges of the separated objects are rough, as the perforations leave a rough and uneven edge on the objects. This is undesirable, particularly when the objects are being used for marketing purposes. Further, the objects are limited to the thickness of the sheet that can be passed through a printer.

SUMMARY

A printable blank sheet includes a top substrate, a center layer adhered to the top substrate with a permanent adhesive, and a release liner adhered to the center layer with a removable adhesive. Perimeter cut lines extend through the top substrate and the center layer of the printable blank sheet and define a perimeter of an object blank in the printable blank sheet. A center cut line extends through the top substrate and into but not through the center layer on the object blank that defines a first object half and a second object half of the object blank.

A method includes running a printable blank sheet through a printer. A top substrate of the printable blank sheet is adhered to a center layer of the printable blank sheet with a permanent adhesive, and the center layer of the printable blank sheet is adhered to a release liner of the printable blank sheet with a removable adhesive. An object blank is removed from the printable blank sheet. The object blank will include the top substrate, the permanent adhesive, the center layer, and the removable adhesive. The object blank will be folded along a center cut line that extends through the top substrate and into but not through the center layer and that defines a first object half and a second object half of the object blank. The first object half of the object blank is adhered to the second object half of the object blank to form an object.

DETAILED DESCRIPTION

Figure 1:
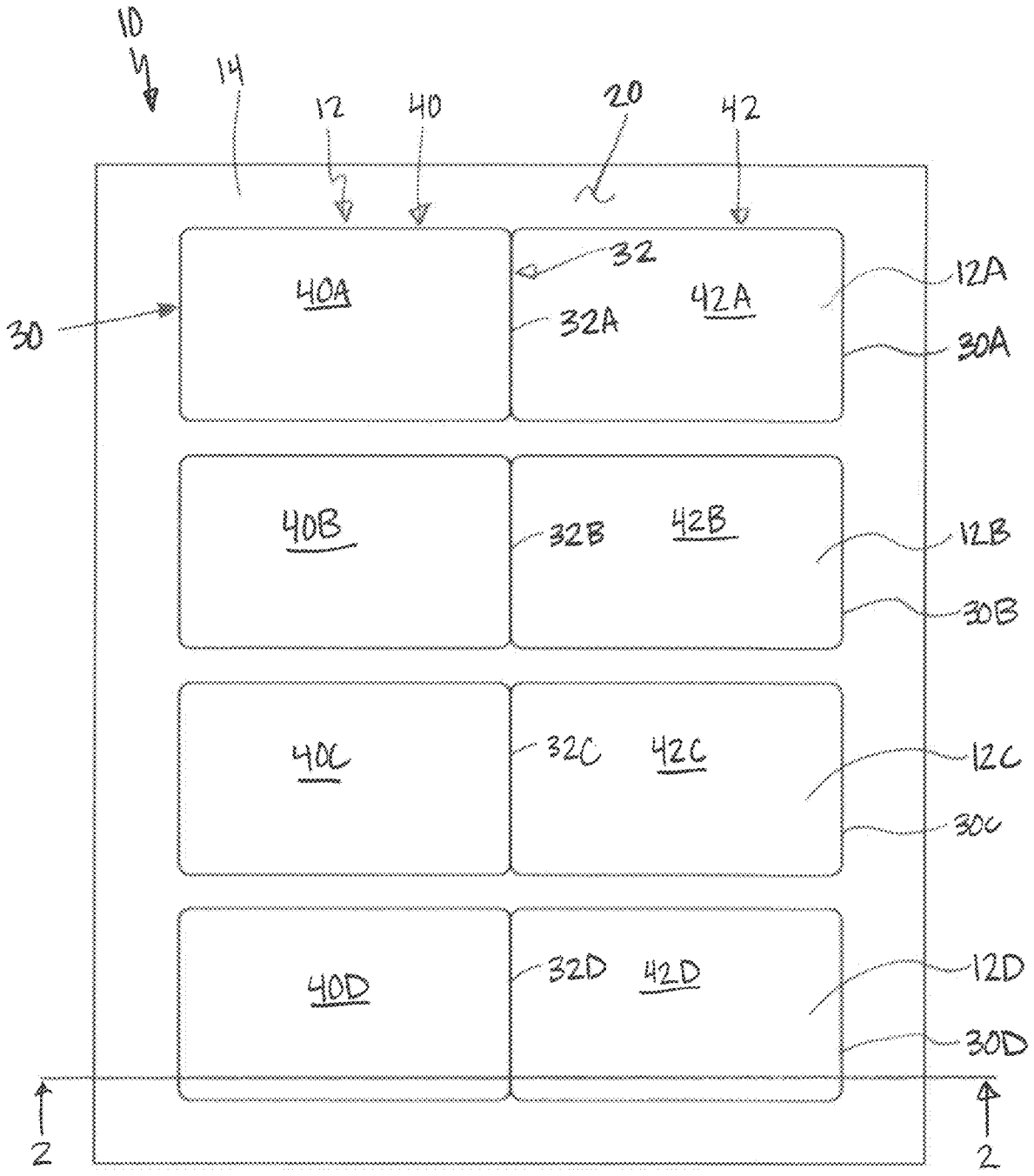
FIG. 1 is a top plan view of a printable blank sheet with object blanks cut into the printable blank sheet.
Figure 2:
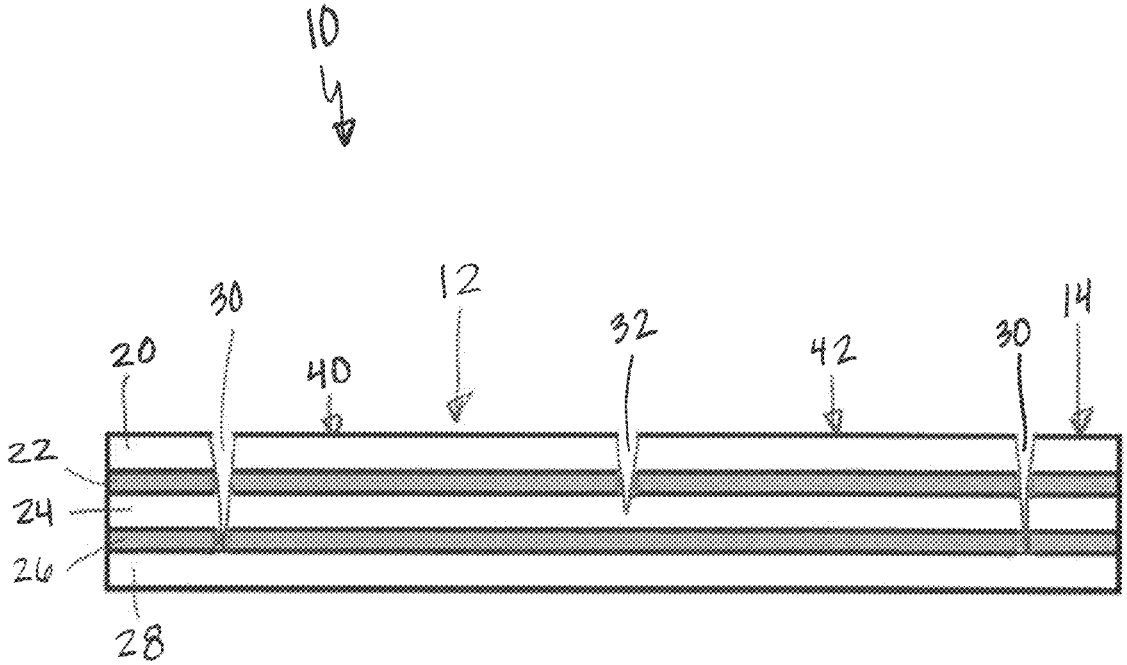
FIG. 2 is a cross-sectional view of the printable blank sheet, taken along line 2-2 of FIG. 1.

FIG. 1 is a top plan view of printable blank sheet 10 with object blanks 12 cut into printable blank sheet 10. FIG. 2 is a cross-sectional view of printable blank sheet 10, taken along line 2-2 of FIG. 1. Printable blank sheet 10 includes object blanks 12 (including object blanks 12A, 12B, 12C, and 12D), excess sheet area 14, top substrate 20, permanent adhesive 22 (shown in FIG. 2), center layer 24 (shown in FIG. 2), removable adhesive 26 (shown in FIG. 2), release liner 28 (shown in FIG. 2), perimeter cut lines 30 (including perimeter cut lines 30A, 30B, 30C, and 30D), center cut lines 32 (including center cut lines 32A, 32B, 32C, and 32D), first object halves 40 (including first object halves 40A, 40B, 40C, and 40D), and second object halves 42 (including second object halves 42A, 42B, 42C, and 42D).

FIG. 1 shows printable blank sheet 10. Printable blank sheet 10 is a flat sheet that is sized to run through a printer. Printable blank sheet 10 includes object blanks 12 (including object blanks 12A, 12B, 12C, and 12D) that are cut into printable blank sheet 10. In the embodiment shown in FIG. 1, printable blank sheet 10 includes four object blanks 12, but printable blank sheet 10 can include any suitable number of object blanks 12 in alternate embodiments. Object blank 12A is positioned between a top of printable blank sheet 10 and object blank 12B; object blank 12B is positioned between object blank 12A and object blank 12C; object blank 12C is positioned between object blank 12B and object blank 12D; and object blank 12D is positioned between object blank 12C and a bottom of printable blank sheet 10. Printable blank sheet 10 also includes excess sheet area 14 that surrounds object blanks 12.

As shown in FIG. 2, printable blank sheet 10 includes five layers. Top substrate 20 forms the top layer of printable blank sheet 10. A top side of top substrate 20 forms the top side of printable blank sheet 10. Permanent adhesive 22 is adhered to a bottom side of top substrate 20 and a top side of center layer 24. Center layer 24 forms the center layer of printable blank sheet 10. Removable adhesive 26 is adhered to a bottom side of center layer 24 and a top side of release liner 28. Release liner 28 forms the bottom layer of printable blank sheet 10. A bottom side of release liner 28 forms the bottom side of printable blank sheet 10.

Top substrate 20 can includes a single layer of material or multiple layers of material. In the embodiment shown in FIGS. 1-2, top substrate 20 is a single layer of material. Top substrate 20 is made out of a material that is capable of being printed on. Top substrate 20 can be made out of paper or a synthetic material such as polyester (PET), polypropylene, vinyl, or other printable synthetic materials. Top substrate 20 has a first color. Top substrate 20 has a thickness between 15 microns and 1,100 microns. In alternate embodiments, top substrate 20 can include multiple layers of material that are adhered together. For example, a top layer of top substrate 20 can be made out of a first material that is capable of being printed on and a second layer of top substrate 20 can be made out of a second material, such as a material for blocking light or a material for blocking radio frequency.

Top substrate 20 is attached to center layer 24 with permanent adhesive 22. Permanent adhesive 22 can be a pressure sensitive adhesive. A pressure sensitive adhesive is a pressure activated adhesive that will form a bond between top substrate 20 and center layer 22 when they are pressed together. Permanent adhesive 22 has a thickness between 25 microns and 200 microns.

Center layer 24 forms a middle layer of printable blank sheet 10. Center layer 24 can be made out of paper, a synthetic material such as polyester (PET), polypropylene, vinyl, or other printable synthetic materials, or a metallized material for blocking RFID. Center layer 24 has a second color. The second color can be the same as the first color of top substrate 20 or it can be different from the first color of top substrate 20. Center layer 24 has a thickness between 15 microns and 1,100 microns.

Center layer 24 is attached to release liner 28 with removable adhesive 26. Removable adhesive 26 is an adhesive that will be permanently adhered to center layer 24 but can be removed from release liner 28. Removable adhesive 26 has a thickness between 25 microns and 200 microns.

Release liner 28 can be made out of any material that allows removable adhesive 26 to pull away from it. Release liner 28 can be made out of a clay coat stock, a synthetic material such as polyester (PET), or other lined media from which removable adhesive 26 can pull away from. Release liner 28 has a thickness between 50 microns and 500 microns.

Printable blank sheet 10 has a thickness between 130 microns and 3,100 microns. The thickness of printable blank sheet 10 is determined based on the thickness of top substrate 20, permanent adhesive 22, center layer 24, removable adhesive 26, and release liner 28. Preferably, the thickness of top substrate 20, permanent adhesive 22, center layer 24, removable adhesive 26, and release liner 28 are sized so that printable blank sheet 10 has a thickness between 290 microns and 450 microns. The thickness of printable blank sheet 10 is selected so that printable blank sheet 10 is capable of being run through a standard printer.

Object blanks 12 are cut into printable blank sheet 10 with perimeter cut lines 30 (including perimeter cut lines 30A, 30B, 30C, and 30C). Perimeter cut lines 30 define the perimeter of object blanks 12. Perimeter cut line 30A defines the perimeter of object blank 12A; perimeter cut line 30B defines the perimeter of object blank 30B; perimeter cut line 30C defines the perimeter of object blank 30C; and perimeter cut line 30D defines the perimeter of object blank 30D. As shown in FIG. 2, perimeter cut lines 30 are kiss cuts that extend through top substrate 20, permanent adhesive 22, center layer 24, and into removable adhesive 26. Perimeter cut lines 30 do not extend through release liner 28.

Object blanks 12 also include center cut lines 32 (including center cut lines 32A, 32B, 32C, and 32D) that cut through a center of each object blank 12. Center cut lines 32 define first object halves 40 and second object halves 42 of each object blank 12. Center cut line 32A extends across a center of object blank 12A and defines first object half 40A and second object half 42A; center cut line 32B extends across a center of object blank 12B and defines first object half 40B and second object half 42B; center cut line 32C extends across a center of object blank 12C and defines first object half 40C and second object half 42C; and center cut line 32D extends across a center of object blank 12D and defines first object half 40D and second object half 42D. As shown in FIG. 2, center cut lines 32 are kiss cuts that extend through top substrate 20, permanent adhesive 22, and into center layer 24. Center cut lines 32 do not extend all of the way through center layer 24. Center cut lines 32 do not extend through removable adhesive 26 or release liner 28.

Each object blank 12 is configured to be assembled into an object. Each object blank 12 can be removed from printable blank sheet 10 and folded in half along center cut line 32 to form the object. In the embodiment shown in FIGS. 1-2, object blanks 12 are business card blanks that are configured to form business cards. First object half 40 will form a top of the business card and second object half 42 will form a bottom of the business card. However, in alternate embodiments, first object half 40 can form the bottom of the business card and second object half 42 can form the top of the business card.

Further, in alternate embodiments, object blanks 12 can be configured to form any suitable objects. For example, object blanks 12 can be used to form postcards, lanyard badges, backstage passes, and similar objects. Additionally, the object that is formed can have any suitable shape. As shown in FIGS. 1-2, the business card that can be formed with object blank 12 will have radius corners to improve the overall appearance and quality of the business card. A separate die cutting process is not required to cut the radius corners of the business card. Similarly, object blanks 12 can be shaped with curved edges to form objects with curved edges.

When printable blank sheet 10 is run through a printer, printing can be printed on both first object half 40 and second object half 42 of object blank 12 at the same time. When object blank 12 is removed from printable blank sheet 10 and folded in half along center cut line 32, printing will be present on both the top and the bottom of the object. A user does not have to run printable blank sheet 10 through a printer twice to print on both a first side and a second side of an object, as both the first object half 40 and the second object half 42 are on the same side of printable blank sheet 10 and can be printed on at the same time.

The object that is formed from each object blank 12 will be thicker than a standard object that can be printed using a standard printer, as the object will be twice the thickness of printable blank sheet 10. The object that is formed can have a thickness between 160 microns and 5,200 microns. Preferably, the business card has a thickness between 580 microns and 900 microns. The object with the increased thickness will have a higher strength, will be sturdier, and will be of a higher value.

The object can also have a center that is a different color or a different material than the front face and back face of the object. Top substrate 20 can have a first color and center layer 24 can have a second color that is different than the first color. When object blank 12 is folded in half along center cut line 32, center layer 24 of first object half 40 and center layer 24 of second object half 42 will be positioned between top substrate 20 of first object half 40 and top substrate 20 of second object half 42. When center layer 24 is a second color that is a different color than the first color of top substrate 20, the center of the object will have a different color than the front face or back face of the object. Center cut line 32 extends partially into center layer 24 so that when object blank 12 is folded along center cut line 32, the edges of center layer 24 will be visible along center cut line 32. Center cut line 32 will extend far enough into center layer 24 so that when object blank 12 is folded along center cut line 32 the center layer 24 will fully separate. However, center cut line 32 does not extend all of the way through center layer 24 so that center layer 24 can hold object blank 12 together when it is removed from printable blank sheet 10. Further, for example, top substrate 20 can be made out of paper and center layer 24 can be made out of a synthetic material to increase the overall strength of the business card. Additionally, center layer 24 can be made out of a metallized material for blocking RFID.

Printable blank sheet 10 allows a user to create a custom object without having to have a specialty print shop print the object. The objects that are formed from object blanks 12 will have a greater thickness than a standard object that can be printed on using a standard printer. Further, perimeter cut lines 30 will give the object clean edges. Also, center layer 24 can be a different color or material than top substrate 20 to allow the object to be further customizable.

Figure 3:
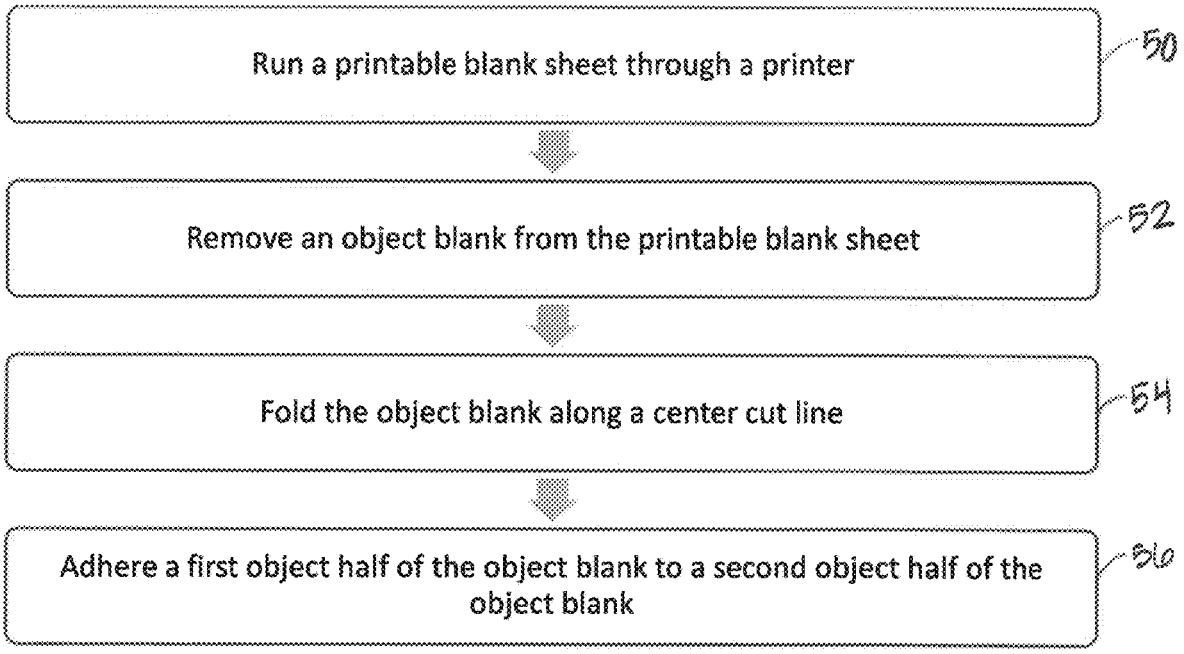
FIG. 3 is a flow chart showing the steps for creating an object from the printable blank sheet.
Figure 4:
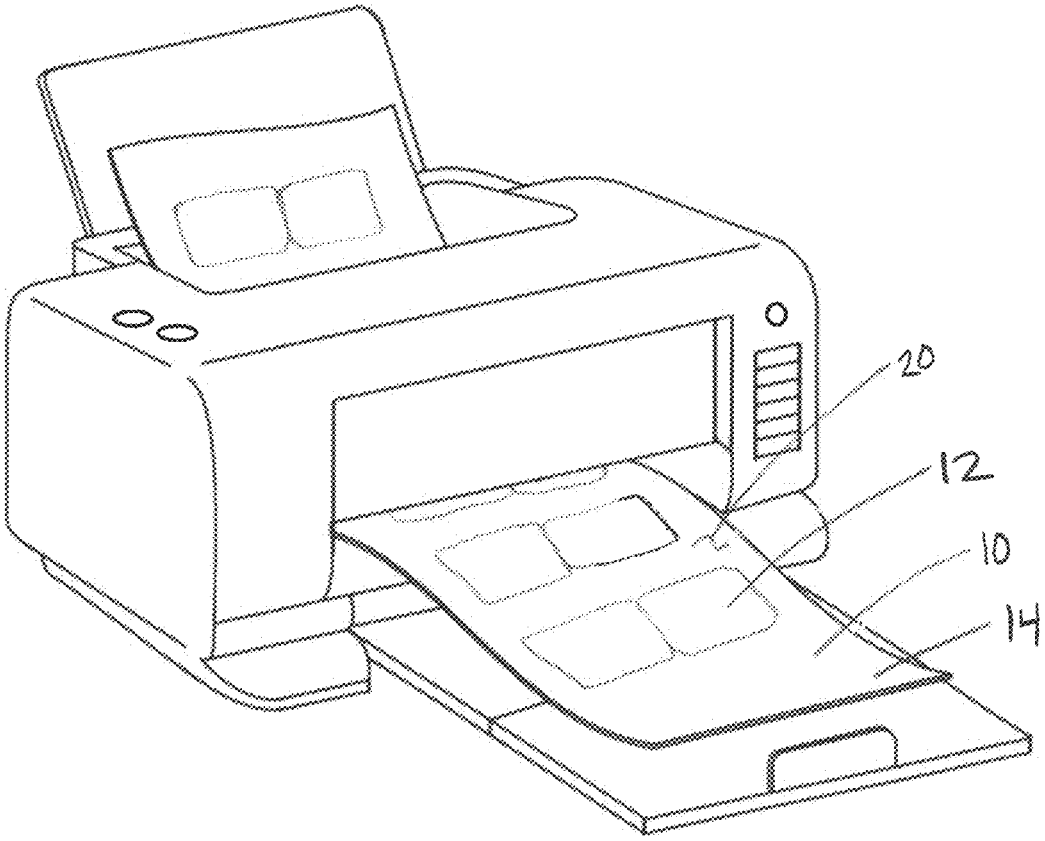
FIG. 4 is a perspective view of the printable blank sheet as it is being run through a printer.
Figure 5:
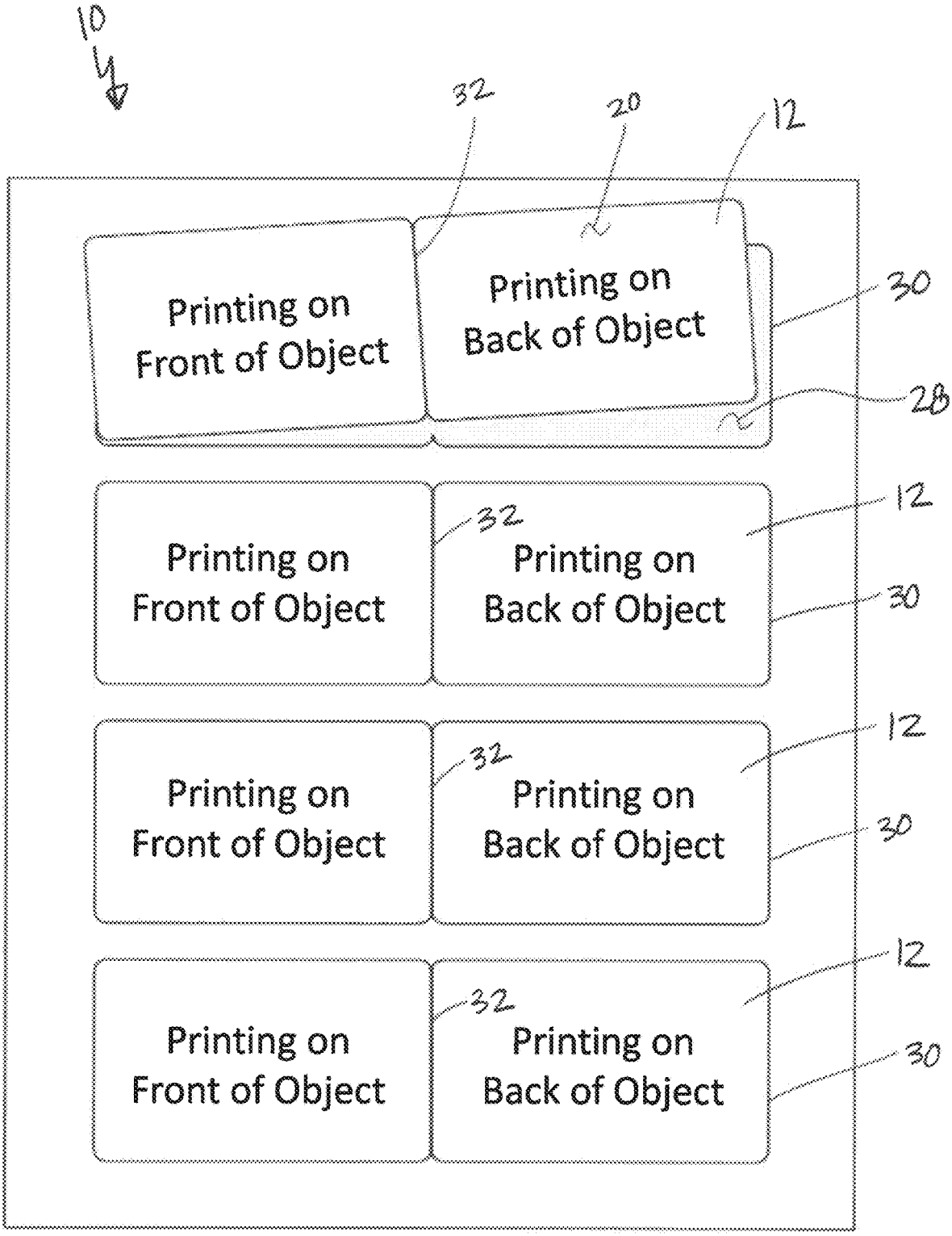
FIG. 5 is a top plan view of the printable blank sheet with an object blank being removed from the printable blank sheet.
Figure 6A:
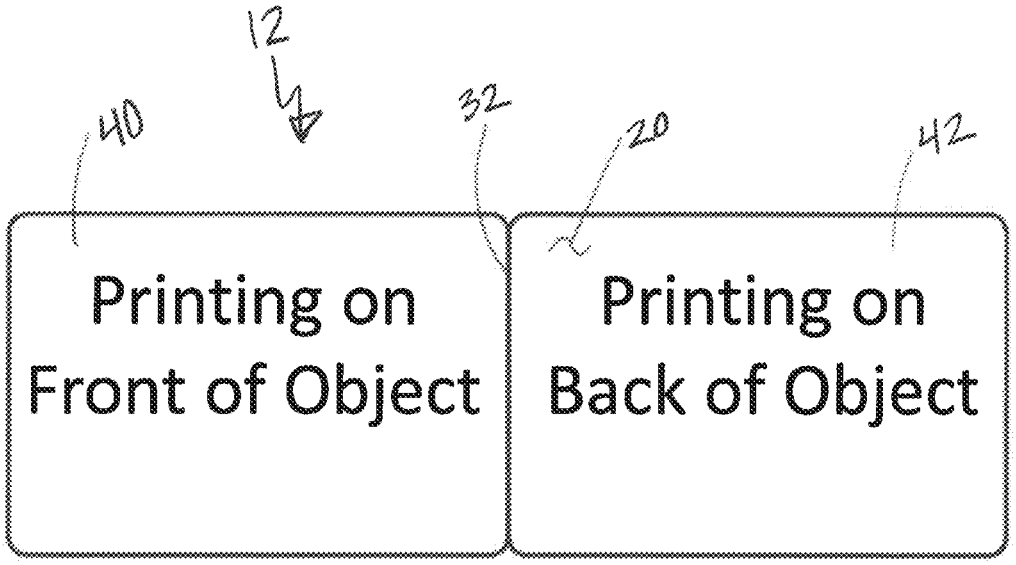
FIG. 6A is a top plan view of the object blank.
Figure 6B:
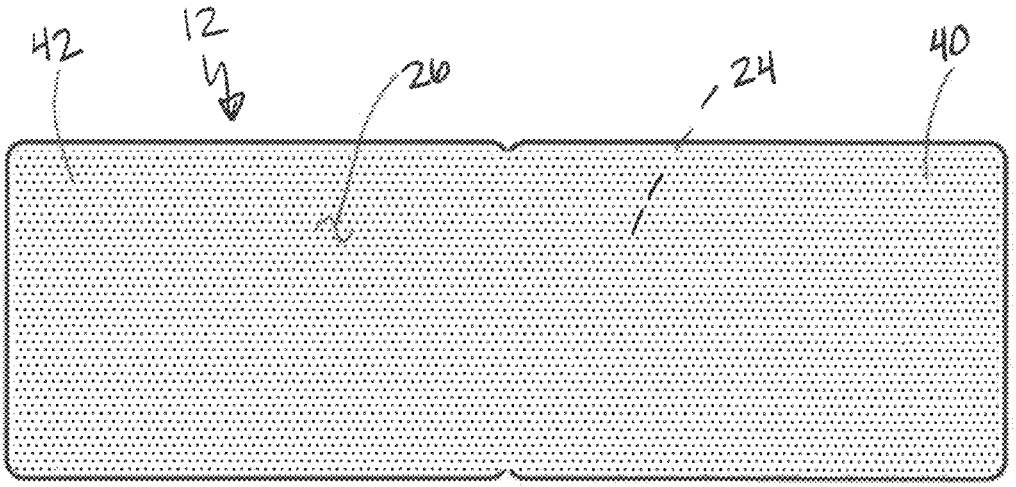
FIG. 6B is a bottom plan view of the object blank.
Figure 6C:
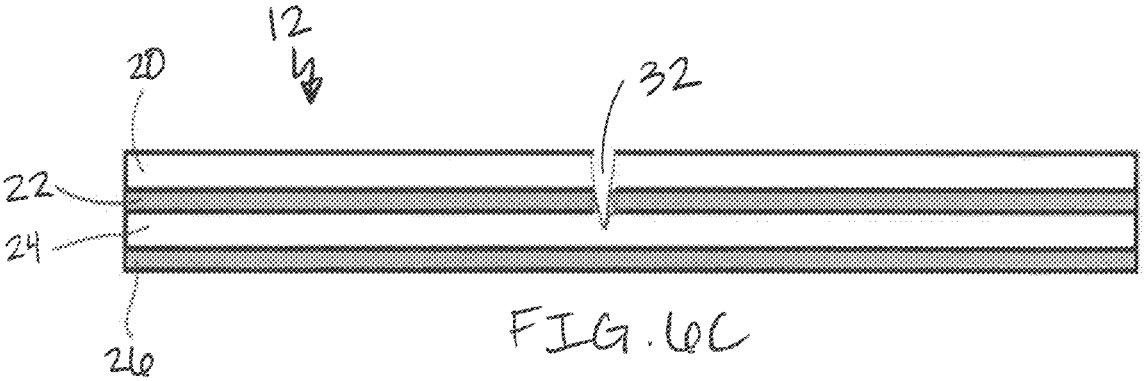
FIG. 6C is a side view of the object blank.
Figure 7:
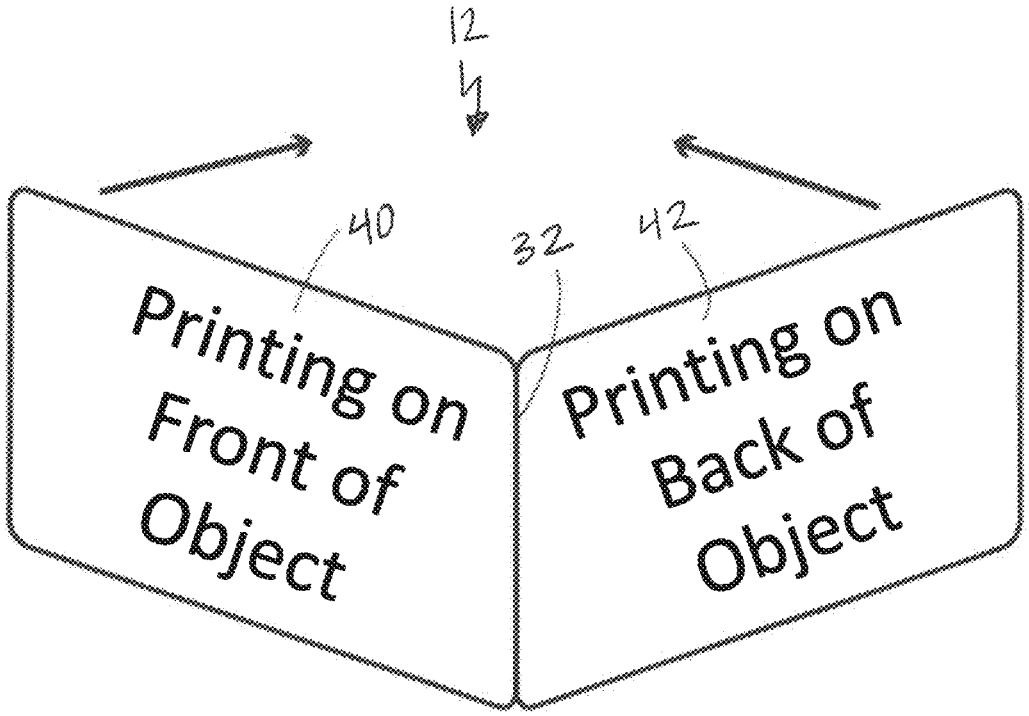
FIG. 7 is a perspective view of the object blank being folded along a center cut line.
Figure 8A:
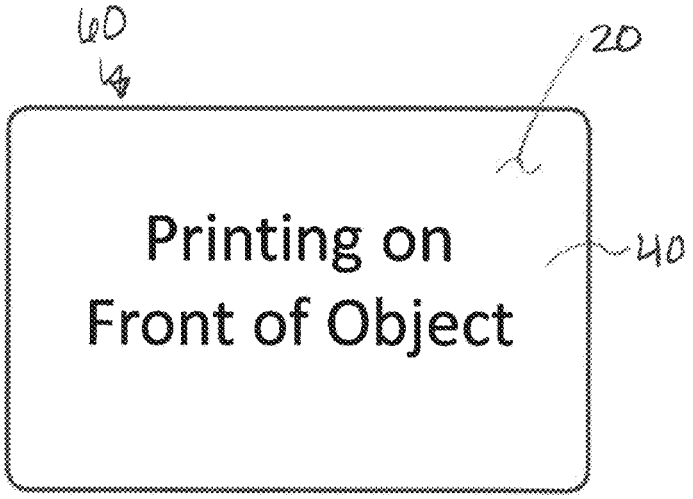
FIG. 8A is a top plan view of an object.
Figure 8B:
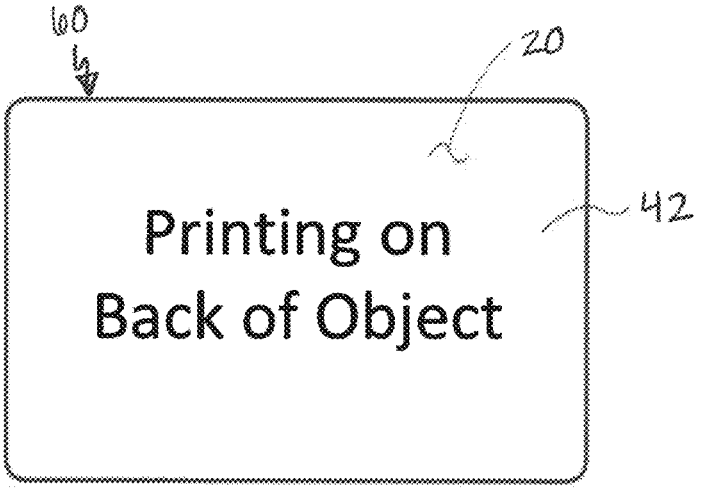
FIG. 8B is a bottom plan view of the object.
Figure 8C:
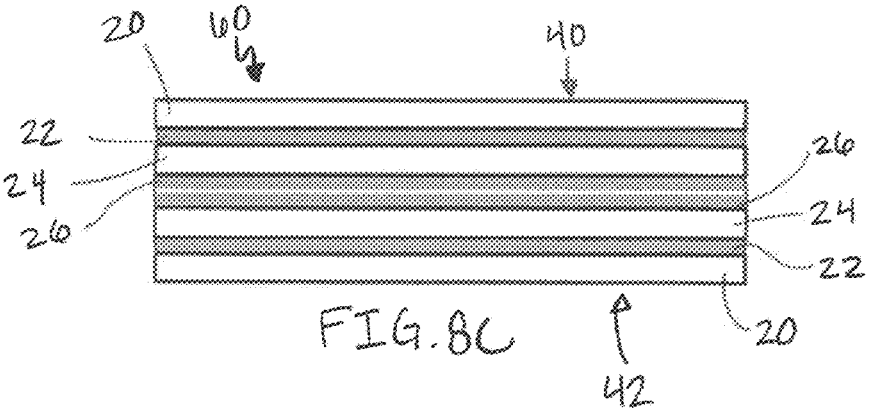
FIG. 8C is a side view of the object.

FIG. 3 is a flow chart showing the steps for creating object 60 from printable blank sheet 10. FIG. 3 includes steps 50, 52, 54, and 56 to show how object 60 can be formed. FIGS. 4-8C show the steps shown in the flow cart in FIG. 3. FIG. 4 is a perspective view of printable blank sheet 10 as it is being run through a printer. FIG. 5 is a top plan view of printable blank sheet 10 with object blank 12 being removed. FIG. 6A is a top plan view of object blank 12. FIG. 6B is a bottom plan view of object blank 12. FIG. 6C is a side view of object blank 12. FIG. 7 is a perspective view of object blank 12 being folded along center cut line 32. FIG. 8A is a top plan view of object 60. FIG. 8B is a bottom plan view of object 60. FIG. 8C is a side view of object 60.

Step 50 includes running printable blank sheet 10 through a printer, as shown in FIG. 4. Printable blank sheet 10 includes top substrate 20, permanent adhesive 22, center layer 24, removable adhesive 26, and release liner 28. Top substrate 20 of printable blank sheet 10 is capable of being printed on. In the embodiment shown, top substrate 20 is a paper layer but top substrate 20 can be made out of any material that is capable of being printed on in alternate embodiments and can include multiple layers of material. Printable blank sheet 10 has a thickness between 130 microns and 3,100 microns, and preferably between 290 microns and 450 microns, to make it suitable for being passed through a standard printer. Further, printable blank sheet 10 is sized so that it can be passed through a standard printer.

Printable blank sheet 10 includes object blanks 12 that are positioned in printable blank sheet 10. As printable blank sheet 10 is run through a printer, object blanks 12 are held in printable blank sheet 10 with removable adhesive 26. Automatic imposition software can be used to create the design that is to be printed on printable blank sheet 10. The automatic imposition software allows a user to create the design for one object blank 12 and then the design is automatically reproduced to be applied to every object blank 12 in printable blank sheet 10. The automatic imposition software will also orient the design so that it is positioned properly on object blanks 12 in printable blank sheet 10.

Step 52 includes removing object blank 12 from printable blank sheet 10, as shown in FIG. 5. Object blank 12 can be removed from printable blank sheet 10 by peeling or pulling object blank 12 away from printable blank sheet 10. Object blank 12 is defined by perimeter cut lines 30. Perimeter cut lines 30 extend through top substrate 20, permanent adhesive 22, center layer 24, and into permanent adhesive 26. When object blank 12 is removed from printable blank sheet 10, it will separate from printable blank sheet 10 along perimeter cut lines 30. As perimeter cut lines 30 do not extend through release liner 28, object blank 12 will not include release liner 28 when object blank 12 is removed from printable blank sheet 10. Object blank 12 will be separated from printable blank sheet 10 between removable adhesive 26 and release liner 28 of printable blank sheet 10. Removable adhesive 26 will pull off of release liner 28 and will remain with object blank 12.

FIGS. 6A-6C show object blank 12 after it has been removed from printable blank sheet 10. As shown in FIG. 6C, object blank 12 will include top substrate 20, permanent adhesive 22, center layer 24, and removable adhesive 26. As shown in FIG. 6A, top substrate 20 will form a top side of object blank 12 and a top side of top substrate 20 will be printed on. Object blank 12 will include printing on first object half 40 that will form the front of object 60 and printing on second object half 42 that will form the back of object 60. As shown in FIG. 6B, removable adhesive 26 will form the bottom side of object blank 12. Removable adhesive 26 covers a bottom side of center layer 24.

Object blank 12 includes first object half 40 and second object half 42. Center cut line 32 defines first object half 40 and second object half 42. As shown in FIG. 6C, center cut line 32 extends through top substrate 20, permanent adhesive 22, and into center layer 24. Center cut line 32 does not extend through center layer 24 or into removable adhesive 26.

Step 54 includes folding object blank 12 along center cut line 32, as shown in FIG. 7. First object half 40 and second object half 42 are folded towards one another along center cut line 32. Object blank 12 is folded along center cut line 32 so that removable adhesive 32 on first object half 40 of object blank 12 is folded towards removable adhesive 32 on second object half 42 of object blank 12. Top substrate 20 of object blank 12 will face outwards on both first object half 40 and second object half 42.

Step 56 includes adhering first object half 40 of object blank 12 to second object half 42 of object blank 12. When removable adhesive 28 on first object half 40 of object blank 12 joins with removable adhesive 28 on second object half 42 of object blank 12, object 60 will be formed. FIGS. 8A-8C show object 60. As shown in FIG. 8A, first object half 40 forms the front of object 60. As shown in FIG. 8B, second object half 42 forms the back of object 60.

FIG. 8C shows the side of object 60. As shown in FIG. 8C, object 60 includes the layers that formed object blank 12 stacked on top of one another. Object 60 includes top substrate 20, permanent adhesive 22, center layer 24, and removable adhesive 26 that formed first object half 40 stacked on top of removable adhesive 26, center layer 24, permanent adhesive 22, and top substrate 20 that formed second object half 42. Removable adhesive 26 of first object half 40 and removable adhesive 26 of second object half 42 join together to form a center portion of object 60. Center layer 24 of first object half 40 and center layer 24 of second object half 42 will be positioned between top substrate 20 of first object half 40 and top substrate 20 of second object half 42.

As discussed above, center layer 24 can have a different color than top substrate 20. Object 60 that is formed with object blank 12 can thus have a center that is a different color than the front face and the back face of object 60. For example, top substrate 20 that forms the front face and back face of object 60 can be white and center layer 24 that forms a center of object 60 can be green, thus forming object 60 that has white faces for printing on and a green center. Any combination of colors can be used.

Printable blank sheet 10 described here allows for customized objects 60 to be made that have a center that is a different color or a different material than faces of object 60. Further, object 60 can be made thicker than standard objects, as object 60 is formed with object blank 12 that is folded in half, doubling the thickness of object 60. Object 60 will includes two top substrates 20, two permanent adhesives 22, two center layers 24, and two removable adhesives 26, which will make object 60 thicker than a standard object. Object 60 can have a thickness between 160 microns and 5,200 microns, and preferably between 580 microns and 900 microns. In the embodiment shown in FIGS. 4-8C, object 60 that is formed with object blank 12 is a business card. In alternate embodiments, object 60 can be any suitable object having any suitable shape, for example a postcard, a lanyard badge, or a backstage pass.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A printable blank sheet comprising:

a top substrate;

a center layer adhered to the top substrate with a permanent adhesive;

a release liner adhered to the center layer with a removable adhesive;

perimeter cut lines extending through the top substrate and the center layer of the printable blank sheet that define a perimeter of an object blank in the printable blank sheet; and a center cut line extending through the top substrate and into but not through the center layer on the object blank that defines a first object half and a second object half of the object blank;

wherein the object blank is configured to be folded along the center cut line to form an object such that an edge of the center layer is visible along the folded center cut line.

2. The printable blank sheet of claim 1, wherein the top substrate is a first color and the center layer is a second color that is different than the first color.

3. The printable blank sheet of claim 1, wherein the top substrate is made out of a first material and the center layer is made out of a second material that is different from the first material.

4. The printable blank sheet of claim 1, wherein the top substrate is made out of a material that is capable of being printed on.

5. The printable blank sheet of claim 1, wherein the top substrate is made out of a material selected from the group consisting of paper, polyester, polypropylene, vinyl, or combinations thereof.

6. The printable blank sheet of claim 1, wherein the top substrate has a thickness between 15 microns and 1100 microns.

7. The printable blank sheet of claim 1, wherein the center layer is made out of a material selected from the group consisting of paper, polyester, polypropylene, vinyl, a metallized material, and combinations thereof.

8. The printable blank sheet of claim 1, wherein the center layer has a thickness between 15 microns and 1100 microns.

9. The printable blank sheet of claim 1, wherein the printable blank sheet is configured to have a thickness between 130 microns and 3,100 microns.

10. The printable blank sheet of claim 1, wherein the object blank is configured to be removed from the printable blank sheet along the release liner.

11. The printable blank sheet of claim 10, wherein the object blank is configured to include the top substrate, the permanent adhesive, the center layer, and the removable adhesive when it is removed from the printable blank sheet.

12. The printable blank sheet of claim 10, wherein the object formed from the object blank is configured to have a thickness between 160 microns and 5,200 microns.

13. The printable blank sheet of claim 10, wherein the center layer of the object blank is configured to fully separate when the object blank is folded along the center cut line to create the object.

14. A method comprising:

running a printable blank sheet through a printer, wherein a top substrate of the printable blank sheet is adhered to a center layer of the printable blank sheet with a permanent adhesive, and wherein the center layer of the printable blank sheet is adhered to a release liner of the printable blank sheet with a removable adhesive;

removing an object blank from the printable blank sheet, wherein the object blank will include the top substrate, the permanent adhesive, the center layer, and the removable adhesive;

folding the object blank along a center cut line that extends through the top substrate and into but not through the center layer and that defines a first object half and a second object half of the object blank; and adhering the first object half of the object blank to the second object half of the object blank to form an object such that an edge of the center layer is visible along the folded center cut line.

15. The method of claim 14, wherein perimeter cut lines define the object blank in the printable blank sheet and extend through the top substrate and the center layer but not through the release liner.

16. The method of claim 14, wherein the top substrate is a first color and the center layer is a second color that is different from the first color so that a center of the object is a different color than faces of the object.

17. The method of claim 14, wherein the top substrate is made out of a first material and the center layer is made out of a second material that is different from the first material so that a center of the object is made out of a different material than faces of the object.

18. The method of claim 14, wherein adhering the first object half of the object blank to the second object half of the object blank includes adhering the removable adhesive on the first object half to the removable adhesive on the second object half.

19. The method of claim 14, wherein removing the object blank from the printable blanks sheet includes separating the removable adhesive from the release liner.

20. The method of claim 14, wherein the object has a thickness between 160 microns and 5,200 microns.

* * * * *